US005695079A

United States Patent [19]

Peay

[11] Patent Number: 5,695,079

[45] Date of Patent: Dec. 9, 1997

[54] DEVICE FOR HANGING AND STORING A WORKPIECE

[75] Inventor: Thomas H. Peay, Antioch, Tenn.

[73] Assignee: Nashville Wire Products Mfg. Company, Inc., Nashville, Tenn.

[21] Appl. No.: 429,108

[22] Filed: Apr. 26, 1995

[51] Int. Cl.[6] ..... A47F 5/08

[52] U.S. Cl. ..... 211/118; 211/119; 248/319

[58] Field of Search ..... 248/317, 319, 248/118; 211/113, 119, 17, 21; 403/93, 95, 96

[56] References Cited

U.S. PATENT DOCUMENTS

| | | | |
|---|---|---|---|
| 579,277 | 3/1897 | Lord et al. | 403/96 |
| 625,746 | 5/1899 | Colsten | 211/17 |
| 729,432 | 5/1903 | Sidway | 403/96 |
| 2,154,161 | 4/1939 | Heckman | 156/33 |
| 3,000,513 | 9/1961 | Horton | 211/119 |
| 3,228,738 | 1/1966 | Koffler | 211/113 |
| 3,245,645 | 4/1966 | Dupler | 248/215 |
| 3,289,985 | 12/1966 | Sheiman | 248/95 |
| 3,469,710 | 9/1969 | Vosbikian | 211/119 |
| 3,834,548 | 9/1974 | Cliffton et al. | 211/118 |
| 4,037,488 | 7/1977 | Laney, Sr. | 403/93 |
| 4,050,616 | 9/1977 | Mosow | 211/17 |
| 4,111,309 | 9/1978 | Henry | 211/104 |
| 4,516,681 | 5/1985 | Jahel | 211/59.1 |
| 4,569,450 | 2/1986 | Dillingham | 211/96 |
| 4,602,889 | 7/1986 | Mu-Shan | 403/95 |
| 4,695,025 | 9/1987 | Vaughn | 403/93 |
| 4,991,722 | 2/1991 | Hight | 211/59.1 |
| 5,069,350 | 12/1991 | Wolf et al. | 211/87 |

*Primary Examiner*—Anthony Knight
*Assistant Examiner*—Curtis Cohen
*Attorney, Agent, or Firm*—Waddey & Patterson; Edward D. Lanquist, Jr.

[57] ABSTRACT

A device for hanging a workpiece such as a bicycle is described. The device includes a hanger assembly having a roll pin, a neck, and a hook that is received by a lug attached to some part of the wire deck and preferably to a joist. The hanger assembly is pivotally received by the lug. The lug having a face placed away from the joist receives the hanger assembly about the roll pin. A biasing member such as a spring is placed to bias the neck toward the face of the lug. The face of the lug is provided with detents which lock the hanger assembly in a raised or lowered position. In a lowered position, a workpiece such as a bicycle can be placed on the hook. When boxes are placed below the hook, the hook can be rotated to a raised position out of the way.

10 Claims, 4 Drawing Sheets

DEVICE FOR HANGING AND STORING A WORKPIECE

BACKGROUND OF THE INVENTION

The present invention relates generally to a storage device and more particularly to a device attached to a wire deck for storing and hanging a workpiece.

It will be appreciated by those skilled in the art that large merchandisers and the like, such as Target, Wal-Mart, and Toys R Us, have large areas in both warehouses and in retail locations for storing inventory. Quite often, this inventory is stored on wire decks. Although most inventory, such as that which is in a box, is best stored on a wire deck, certain matters, especially, seasonal items, such as bicycles, take up much room on a deck. As a result, items such as bicycles, take up much storage room. Additionally, individuals having wire deck arrangements, in order to exploit the storage space to the best manner, either have to stack inventory as high as possible between decks or place decks very close together. Stacking inventory above a certain height may damage the inventory. Putting decks close together decreases the flexibility of inventory in that space. Additionally, items such as bicycles and other items which don't come in boxes, are not easily stored on boxes of inventory. Additionally, stacking items on boxed inventory may damage the boxed inventory.

It will further be appreciated by those skilled in the art that many companies have existing wire deck systems. These wire deck systems have served their users well over their existence. However, as discussed above, the wire deck systems have limited flexibility.

Prior art shows many examples of items such as hooks and shelves which are placeable in two positions. An example of these are U.S. Pat. Nos. 2,154,161; 3,245,645; 3,469,710; 4,111,309; 4,516,681; 4,569,450; 4,991,722; 5,069,350; 3,289,985. However, none of these references discuss the use in connection with large items. Additionally, none of these items discuss the use of dual positioned items for storage.

What is needed, then, is a system which takes advantage of existing wire decking to increase storage both by size and by flexibility. This needed system must be capable of receiving items such as bicycles while at the same time being out of the way when receiving members are not in use. This device must be capable of housing inventory so that it is not stacked on top of existing inventory below it. This device is presently lacking in the prior art.

SUMMARY OF THE INVENTION

The present invention discloses a device for hanging a workpiece. In the present invention, a hanger assembly having a roll pin, a neck, and a hook is received by a lug attached to some part of the wire deck and preferably a joist. The hanger assembly is pivotally received by the lug. A lug having a face placed away from the joist receives the hanger assembly about the roll pin. A biasing member such as a spring is placed to bias the neck toward the face of the lug. The face of the lug is provided with detents which lock the hanger assembly in a raised or lowered position. In a lowered position, a workpiece such as a bicycle can be placed on the hook. When boxes are placed below the hook, the hook can be rotated to a raised position out of the way.

Accordingly, one object of the present invention is to provide a device which can be simply attached to existing wire decks to hang a workpiece.

A still further object of the present invention is to provide a device which can be placed in a lowered position to receive a workpiece but placed in a raised position out of the way when desired.

A still further object of the present invention is to provide a device which is very simple and easy to manufacture.

DESCRIPTION OF THE PREFERRED EMBODIMENT

Figure 1:
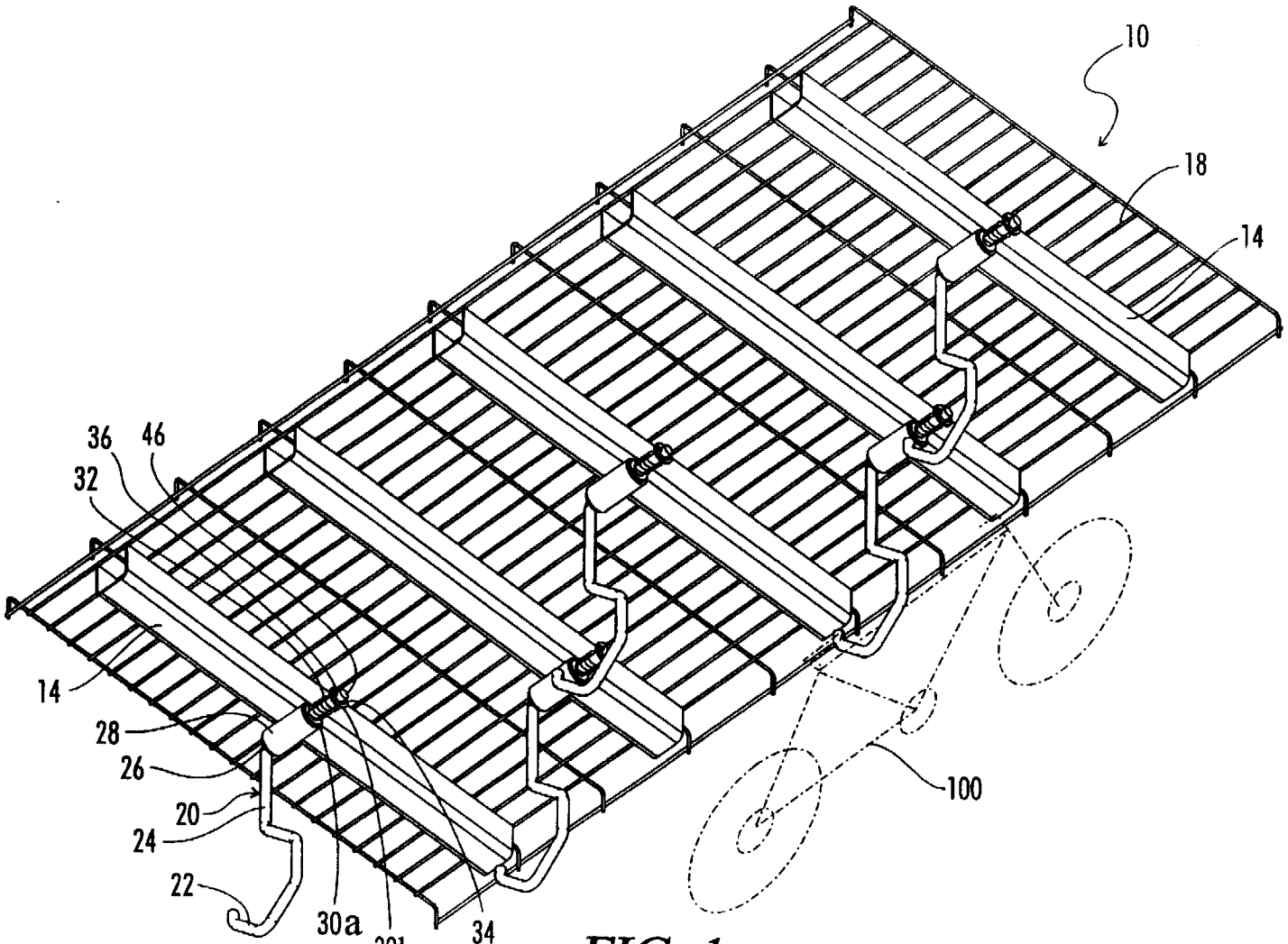
FIG. 1 is a perspective view of the wire deck showing the device in a lowered position.

Referring now to FIG. 1, them is shown generally at 10 the device for hanging and storing a workpiece. In this particular view, device 10 and specifically hook 22 is in a lowered position. Wire deck 10 is an ordinary wire deck having joist 14 to support deck material 18. This type of wire deck is commonly sold throughout the United States. In the preferred embodiment, lug 28 is fixedly attached to joist 14 in a conventional manner such as by welding. Lug 28 has hole 16 which receives hanger assembly 20. Preferably, lug 28 is a short piece of pipe or tubing having a flatened side to better engage deck 10. Hanger assembly 20 consists of hook 22, neck 24, and roll pin 26. Therefore, hole 16 of lug 28 actually receives roll pin 26. After roll pin 26 is received by hole 16, around portion of roll pin 26 distally located from neck 24 there is placed washer **30*a*. Its only critical limitation is that its center is larger than roll pin 26 and its flange contacts lug 28. Spring 32 is then placed between lug 28 and distal end 46 of roll pin 26. After spring 46 there is placed washer 30*b* which has similar critical limitations to washer 30*a* except that flange of washer 30*b* merely need be sufficiently sized to engage cotter pin 34 placed in orifice 36 without sliding off roll pin 26. The combination of the two washers 30*a* and 30*b* along with spring 32 act to bias distal end 46 away from lug 28 such that neck 24 of hanger assembly 20 is biased toward face (44 in FIG. 3). As can be seen in phantom in FIG. 1, hooks 22 receive workpiece 100 which is, in this FIG. 1**, a bicycle.

Figure 2:
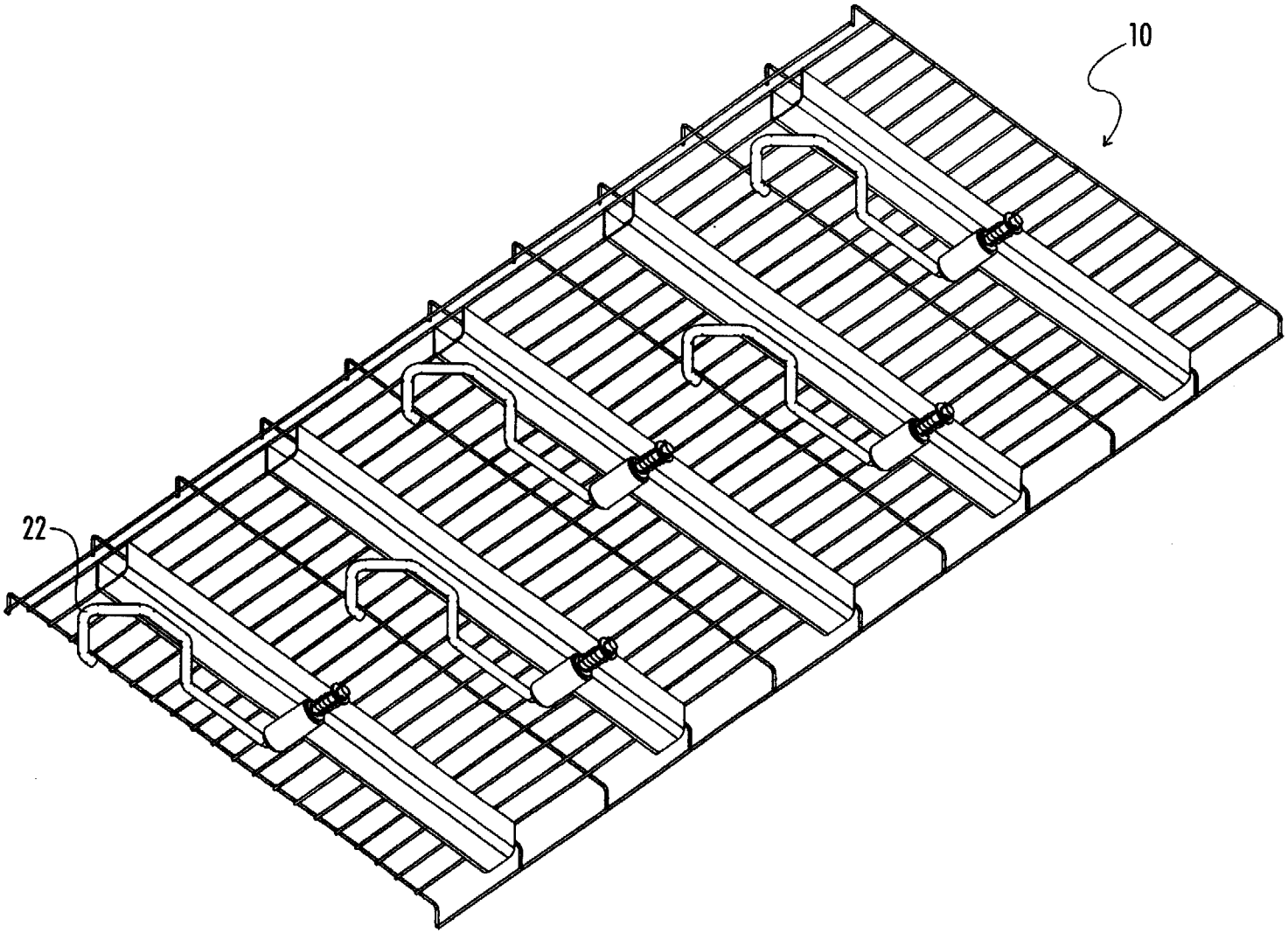
FIG. 2 is a perspective view of the wire deck having the device shown in a raised position.

Referring now to FIG. 2, there is shown generally at 10 the device of the present invention with hooks 22 placed in raised or closed position. Device 10 is in position shown in FIG. 2 when hooks 22 are no longer needed.

Figure 3:
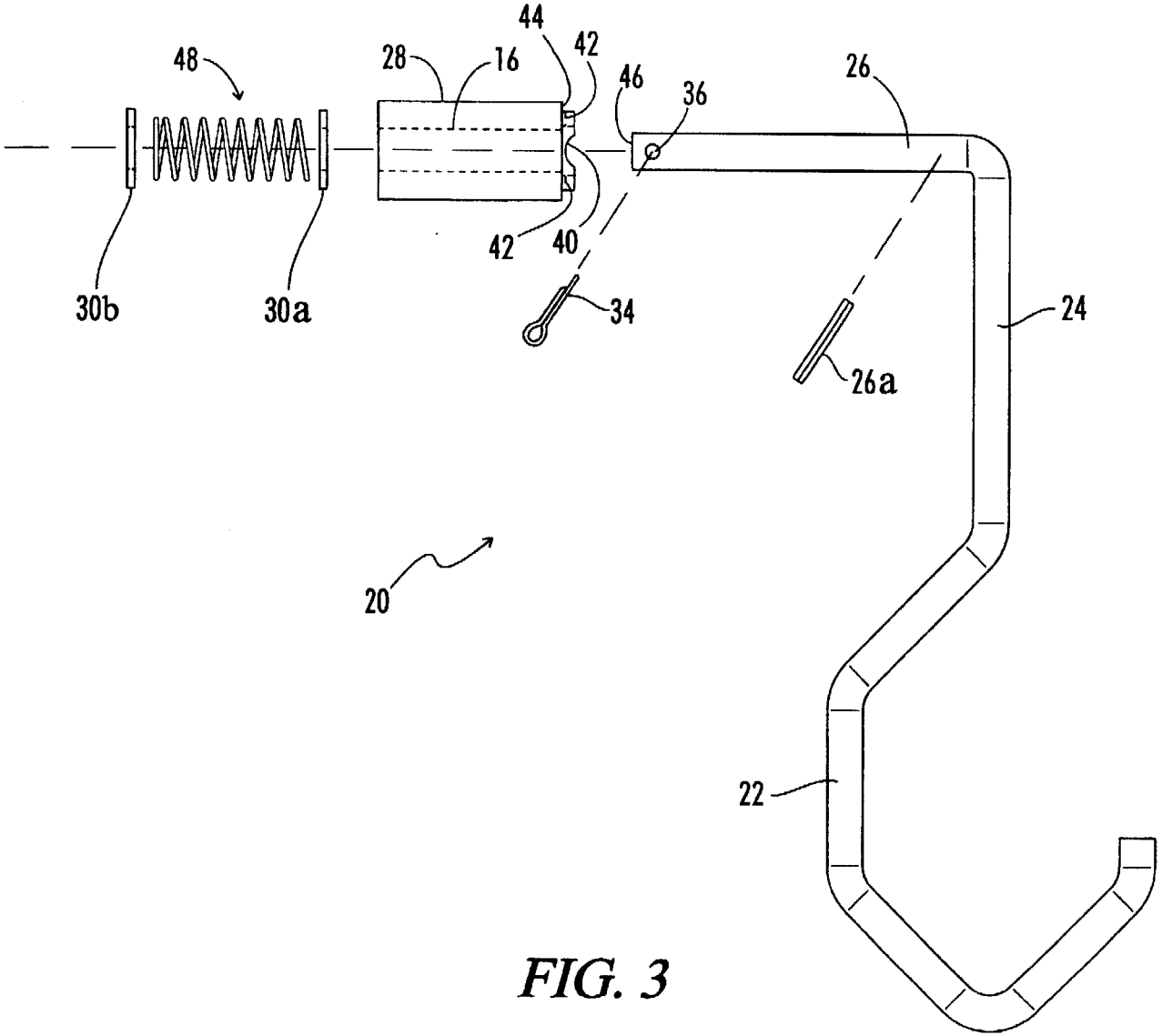
FIG. 3 is an exploded view of the hanger assembly and lug of the present invention.
Figure 4B:
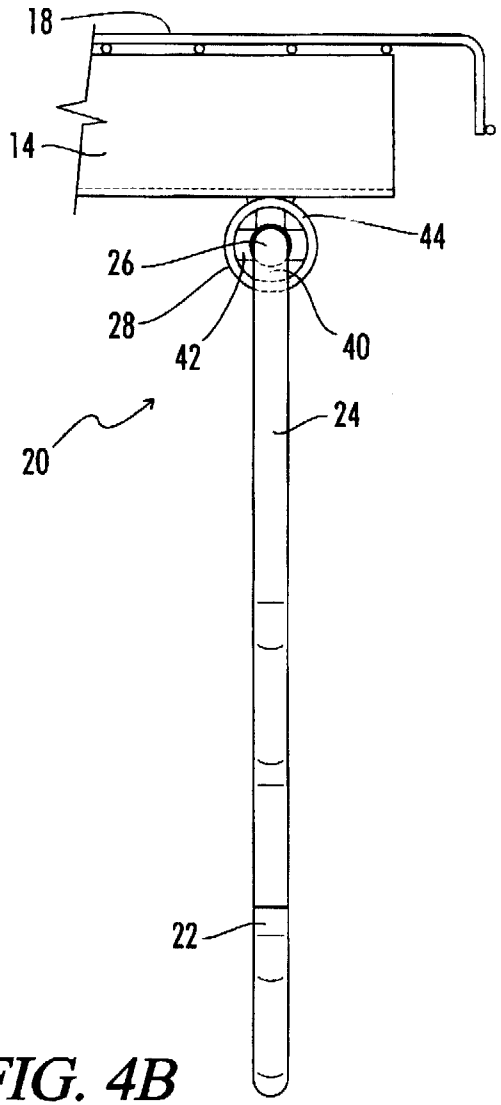
FIG. 4B is a end view of the device of the present invention.
Figure 4A:
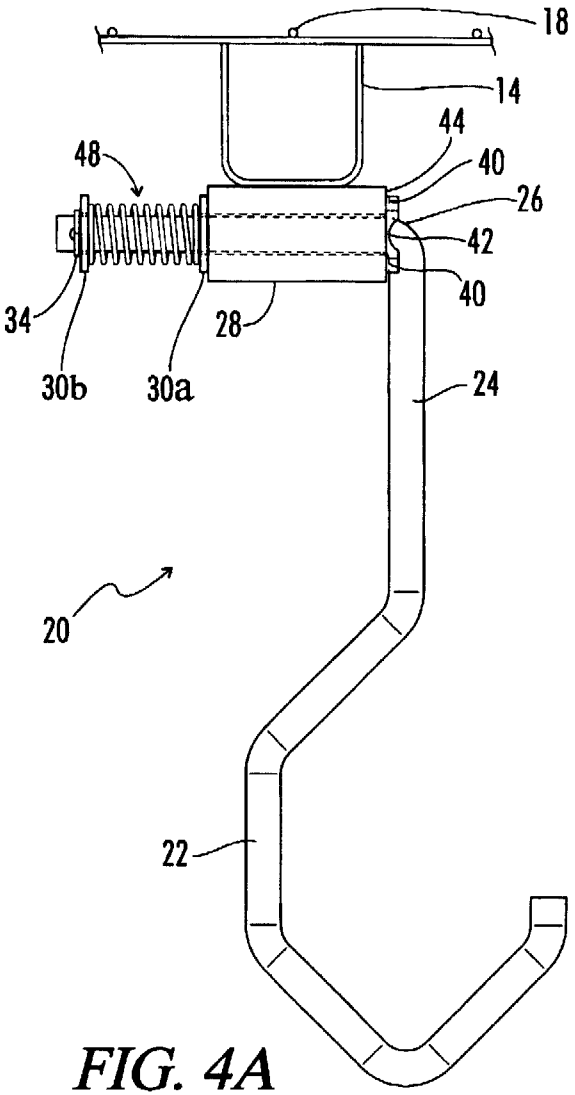
FIG. 4A is a side view of the device of the present invention.

Referring now to FIG. 3 and FIGS. 4A and 4B, there is shown generally at 20 the hanger assembly of the present invention at 48, the bias assembly of the present invention and at 28, the lug of the present invention. As can be seen in the exploded view as shown in FIG. 3 and FIGS. 4A and 4B, hanger assembly 20 has roll pin 26, elongated neck 24, and hook 22. On proximal distal end 46 of roll pin 26 there is placed orifice 36 which receives cotter pin 34. In construction, roy pin 26 is placed through hole 16 and lug 28. After lug 28 is placed on roll pin 26, washer **30*a* is placed over roll pin 26. Spring 48 is next placed followed by washer 30*b*. Spring causes lug 28 to be biased toward neck 24 and away from distal end 46**.

Continuing on FIG. 3 and FIGS. 4A and 4B, on the face 44 of lug 28 there are raised detent 42 and lowered detent 40, raised detent 42 receiving neck 24 when hook 22 is at a raised position; and lowered detent 40 receiving neck 24 when hook 22 is at a lowered position. Spring 48 biases neck 24 into one of the detents 40, 42.

An optional supplemental roll pin is shown at 26a on FIG. 3. Supplemental roll pin 26a is attached to hanger assembly 20 at the intersection of roll pin 26 and neck 24. Roll pin 26a also contacts detents 40, 42 to lock hanger assembly 20 into the desired position.

Thus, although there have been described particular embodiments of the present invention of a new and useful Device for Hanging and Storing a Workpiece, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for hanging and storing a workpiece comprising, in combination:

a. a shelf;

b. receiving means for releasibly receiving the workpiece, said receiving means attached to said shelf wherein said receiving means for releasibly receiving the workpiece comprises an elongated neck attached to a roll pin at one end and a hook at the other;

c. means for pivotally attaching said shelf said receiving means for releasibly receiving the workpiece, wherein said means for pivotally attaching to said shelf said receiving means for releasibly receiving the workpiece comprises a lug for receiving said roll pin attached to said shelf, said roll pin having an orifice, and a cotter pin received by said orifice; and d. means for locking in a raised and a lowered position said receiving means for releasibly receiving the workpiece, wherein said means for locking in a raised and a lowered position said receiving means for releasibly receiving the workpiece comprises a lug having a face, said face having a detent for receiving the neck in a raised position and a detent for receiving the neck in a lower position; and means for biasing said neck into either one of said detents in said face of said lug.

2. The device of claim 1 wherein said means for biasing said neck into one of said detent in said face comprises a spring.

3. A device for hanging and storing a workpiece comprising, in combination:

a. a shelf;

b. an elongated neck attached to a roll pin at one end and a hook at the other;

c. a first lug for pivotally attaching said elongated neck to said shelf, said lug receiving said roll pin, said first lug attached to said shelf, said roll pin having an orifice; and a cotter pin received by said orifice; and d. said lug having a face, said face having a detent for receiving the neck in a raised position and a detent for receiving the neck in a lower position, said lug receiving said elongated neck; and means for biasing said neck into one of said detents in said face of said lug wherein said means for biasing said neck into either one of said detents in said face of said lug comprises a spring.

4. A device for storing a workpiece comprising combination:

a. a deck having a joist on an underside;

b. receiving means for releasibly receiving the workpiece attached to said joist, wherein the receiving means for releasibly receiving the workpiece comprises a hanger assembly;

c. means for pivotally attaching to said joist said receiving means for releasibly receiving the workpiece; and d. means for locking in an raised and a lowered position said receiving means for releasibly receiving the workpiece, wherein said means for locking in an raised and a lowered position said receiving means for releasibly receiving the workpiece comprises a lug having a face, said face having a detent for receiving the hanger assembly in a raised position and a detent for receiving the hanger assembly in a lowered position; and means for biasing said neck into either one of said detents.

5. The device of claim 4 wherein said hanger assembly comprises an elongated neck attached to a roll pin at one end and a hook at the other.

6. The device of claim 4 wherein said means for pivotally attaching to said deck said receiving means for releasibly receiving the workpiece comprises a lug attached to said deck.

7. The device of claim 4 wherein said means for biasing said neck into one of said detents comprises a spring.

8. A device for hanging a workpiece comprising, in combination;

a. a wire deck;

b. a lug attached to said wire deck having a hole;

c. a hanger assembly having a hook, a neck, a roll pin, and an orifice, said roll pin pivotally received by said hole of said lug;

d. a cotter pin received by said orifice;

e. said lug having a face placed distally from a joist, said face having a detent for receiving said neck when said hanger assembly is at a raised position and a detent for receiving said neck when said hanger assembly is at a lowered position; and f. a spring assembly receiving said roll pin for biasing said neck into one of said detents.

9. A device for hanging and storing a workpiece, the device comprising, in combination:

a. a shelf;

b. a hanger assembly including a hook at one end and a roll pin at an other end;

c. a lug for pivotally attaching said hanger assembly to said shelf, said lug receiving said roll pin, said lug attached to said shelf, d. said lug having a face, said face having a detent for receiving said hanger assembly in a raised position and a detent for receiving said hanger assembly in a lowered position; and e. a spring for biasing said hanger assembly into either one of said detents in said face of said lug.

10. The device of claim 9 further comprising said roll pin having an orifice; and a cotter pin received by said orifice.

* * * * *